United States Patent [19]

Schedele

[11] 4,359,703

[45] Nov. 16, 1982

[54] ELECTROMAGNETIC RELAY

[75] Inventor: Helmut Schedele, Diessen, Fed. Rep. of Germany

[73] Assignee: Siemens Aktiengesellschaft, Berlin & Munich, Fed. Rep. of Germany

[21] Appl. No.: 272,664

[22] Filed: Jun. 11, 1981

[30] Foreign Application Priority Data

Jul. 8, 1980 [DE] Fed. Rep. of Germany ..... 3025834

[51] Int. Cl.[3] ..... H01H 51/08

[52] U.S. Cl. ..... 335/202; 335/128

[58] Field of Search ..... 335/202, 128, 154, 187, 335/132

[56] References Cited

U.S. PATENT DOCUMENTS 3,544,930 12/1970 Sauer ..... 335/154

4,087,667 5/1978 Heider et al. ..... 200/245

*Primary Examiner*—Harold Broome

*Attorney, Agent, or Firm*—Hill, Van Santen, Steadman, Chiara & Simpson

[57] ABSTRACT

An electromagnetic relay has an armature and a number of contact elements disposed in the hollow interior of the spool about which the coil is wound. The contact elements are held in position by respective contact mounts which are inserted in the axial direction from both open end faces of the coil spool. The contact mounts are U-shaped within the coil spool and are aligned therein by the engagement of ribs carried on the contact mounts with corresponding guide grooves in the interior of the coil spool, thereby accurately and fixedly positioning the contact elements.

11 Claims, 6 Drawing Figures

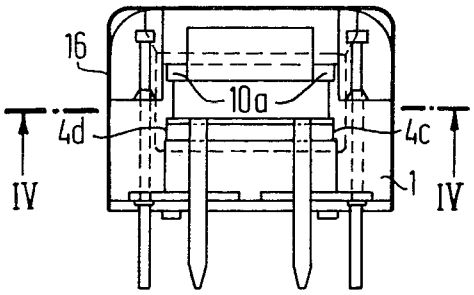
FIG 3
FIG 2
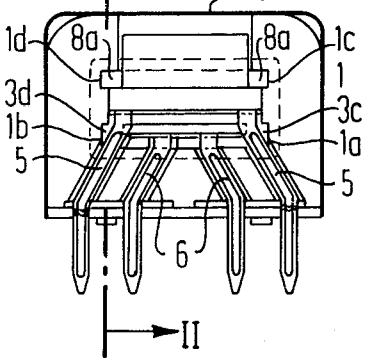
FIG 1
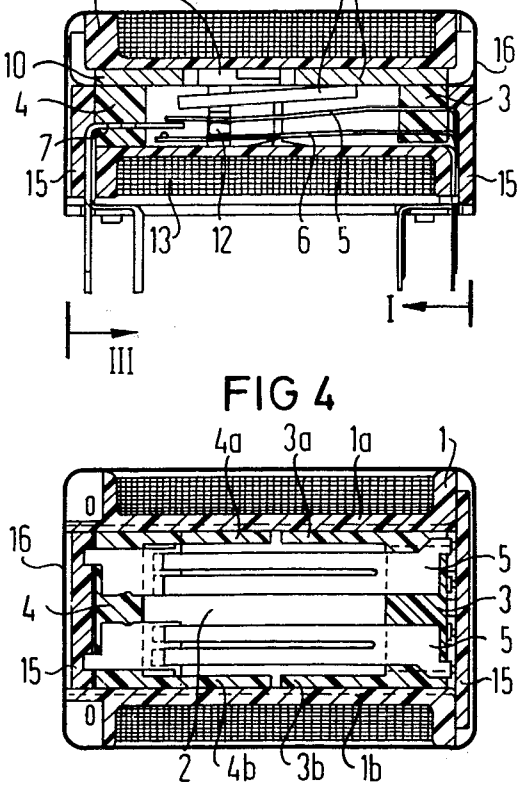
FIG 4

24
24e
1e
1d
1b
24d
1

8
8c
23f
8b
23i
8c
23e
24f
24h
24i
10b
10c
24e
10
24
2a
24a
24g
24g
24g
24K
23
23g
23g
23a
1

ELECTROMAGNETIC RELAY

BACKGROUND OF THE INVENTION

1. Field of the Invention

The present invention relates to an electromagnetic relay having contact elements disposed substantially axially parallel within the hollow interior of the coil spool, which contact elements are actuated by means of a flat armature, and specifically relates to such a relay having contact element mounts which are inserted into the opposite open end faces of the coil spool.

2. Description of the Prior Art

A relay having operative elements disposed within the hollow interior of the spool about which the electromagnetic coil is wound is known from German AS 16 39 417 corresponding to U.S. Pat. No. 3,544,930. The relay disclosed therein has two contact mounts which, in one embodiment, are substantially disc shaped and are inserted into a flange of the coil. One contact mount additionally carries the relay yoke as well as the armature, and the other contact mount carries the pole piece. This structure, however, has the disadvantage that because of the short length of fit between the coil spool flanges and the particular contact mount, the danger exists that the pole shoes held in the contact mounts are not in precise alignment with one another, so that the armature does not rest level along its entire length. Moreover, the danger exists that the cooperating contact elements which are inserted into the interior of the coil spool from opposite directions will exhibit large and imprecise tolerances with regard to the spacing between the actual electrical contacts carried on the ends thereof. A subsequent adjustment to correct such imprecision is not possible after the contact mounts have been inserted.

In another embodiment disclosed in U.S. Pat. No. 3,544,930, a contact mount is provided which carries all of the contact elements and pole shoes and is inserted into the coil former from one side. In this structure, the contact spacings can be adjusted before insertion, however, the structure has the disadvantage that, at least on one flange side, the terminals of the leaf spring must be subsequently bent over the plastic edge of the carrier. Additionally, the assembly of all parts on a single contact mount is time-consuming and difficult to achieve during automated or manual assembly.

SUMMARY OF THE INVENTION

It is an object of the present invention to provide an electromagnetic relay in which the operable components are disposed in the interior of the hollow coil spool permitting all elements of the magnetic circuit and the contact spring set to be assembled in a simple manner with deviations from acceptable tolerances in the spacings between electric contacts being substantially minimized and the position of the contacts being relatively fixed.

The above objects are inventively achieved in an electromagnetic relay of the type described above wherein two contact mounts consisting of synthetic material and each having a U-shape such that their lateral arms enclose the contact elements, are each guided in guide grooves of the coil spool by means of correspondingly engaging ribs carried on the contact mounts up to the region of the center of the coil spool.

The above structure by the use of the engaging ribs and grooves insures that assembly tolerances between cooperating contact elements and other parts of the magnetic system are kept at a minimum beyond a nominal value. The entire magnetic and contact system which is carried on the two separate contact mounts can be assembled and adjusted by an appropriate device before insertion into the coil spool. This adjustment is then retained during the insertion of the two contact mounts.

In order to match the guide grooves of the coil spool laterally protruding guide ribs can be molded onto the contact mounts. The contact mounts may also be constructed in a known manner, in layers or by injection molding in one piece. Depending upon the type of contact mount, the contact elements can then be applied in layers or injected in a manner which is also known. The yoke and pole piece can be connected to the contact mounts in a known manner such as, for example, by insertion in recesses or fastening by means of integral plastic pins. It is preferable if the yoke and pole piece laterally protrude over the width of the contact mounts and similarly lie in guide grooves of the coil spool.

In order to retain their adjusted position during insertion of the contact mounts, the pole piece and yoke are preferably provided with assembly shoulders at which slides of the assembly device can engage. The pole piece and the yoke are preferable L-shaped so that the magnetic contact resistance between those parts and a metal cap which serves for flux guidance is as small as possible.

The relay may carry a plurality of contact units which are disposed beside one another. Each contact unit preferably consists of a central contact secured to one of the contact mounts and of two counter-contact leaf springs which are secured to the other contact mount and pre-loaded against the central contact associated therewith. In order to facilitate the assembly, it is preferable that the counter-contact springs have unequal lengths.

DESCRIPTION OF THE DRAWINGS

FIG. 1 is a sectional view of one end of an electromagnetic relay constructed in accordance with the principles of the present invention taken along line I—I of FIG. 2.

FIG. 2 is a longitudinal sectional view of a relay constructed in accordance with the principles of the present invention.

FIG. 3 is a view of the opposite end of a relay constructed in accordance with the principles of the present invention taken along line III—III of FIG. 2.

FIG. 4 is a lateral sectional view of the relay shown in FIG. 2.

DESCRIPTION OF THE PREFERRED EMBODIMENTS

Figures 5, 6:
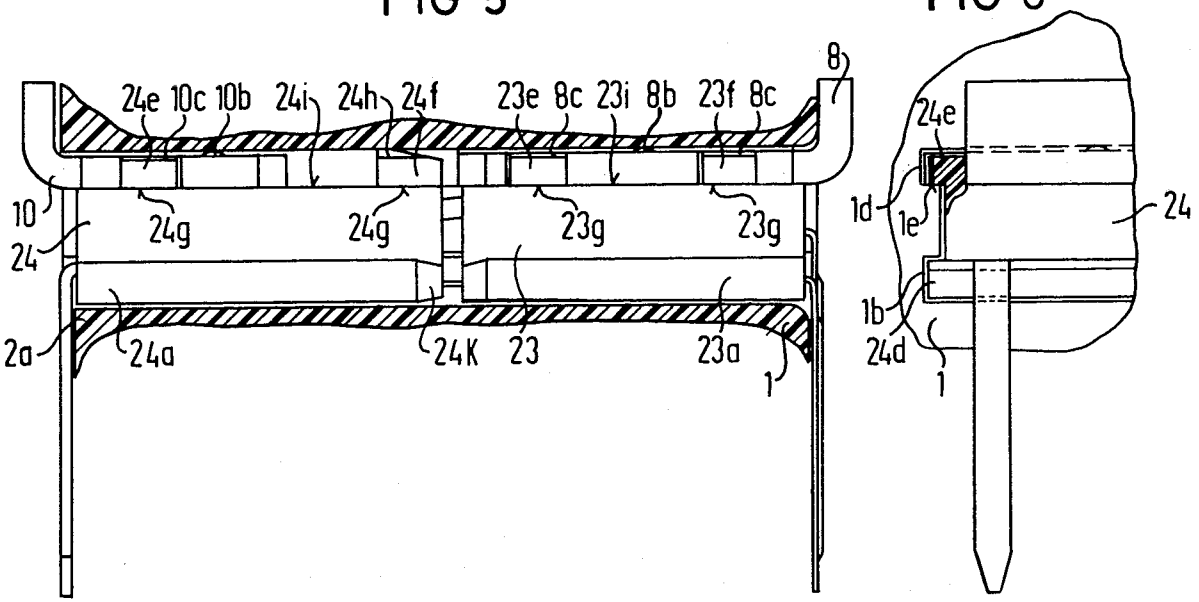
FIG. 5 is a sectional view of a portion of a further embodiment of the electromagnetic relay constructed in accordance with the principles of the present invention having additional positioning and guide means.
FIG. 6 is a partial view of the contact mount for the embodiment of FIG. 5 at an end face of the relay.

An electromagnetic relay constructed in accordance with the principles of the present invention is shown in various sectional views in FIGS. 1 through 4. The relay has a coil spool 1 about which the coil is wound and which serves as a carrier for all operative elements of the relay within the hollow interior 2 of the spool 1. Two U-shaped contact mounts 3 and 4 support the various elements in the interior 2 of the spool 1. The mount 3 carries counter-contact springs 5 and 6 in the embodiment shown in the drawings, however, it will be understood that more contact springs may be employed as may be necessary for particular applications. For each contact unit there is provided an upper counter-contact spring, such as the spring 5, and a lower counter-contact spring such as the spring 6. The counter-contact springs 5 and 6 are pre-loaded against one another and against a stationary central contact 7 associated therewith. The stationary central contact 7, and such other central contacts as may be needed, are each connected to the contact mount 4 next to one another and may, for example, be embedded therein.

On its upper side the contact mount 3 carries a yoke 8 and an armature 9. The armature 9, together with a pole piece 10, forms the working air gap. The pole piece 10 is secured to the contact mount 4, for example, by riveting.

The two contact mounts 3 and 4 are each U-shaped having respective lateral arms 3*a* and 3*b* and 4*a* and 4*b* which extend on both sides of the contact elements approximately up to the center of the coil spool 1. The lateral arms serve to guide the mounts 3 and 4 in guide grooves 1*a* and 1*b* disposed in the interior 2 of the coil spool 1. Guide ribs 3*c* and 3*d*, respectively carried on lateral arms 3*a* and 3*b*, and guide ribs 4*c* and 4*d*, respectively carried on lateral arms 4*a* and 4*b*, engage the guide grooves in the interior of the coil spool 1. Additional guide grooves 1*c* and 1*d* are present in the coil spool for the yoke 8 and the pole piece 10, which are each connected to the contact mounts 3 and 4 but which laterally protrude over the mounts and are additionally guided in the coil spool 1. In order to insure a defined and fixed insertion of all parts into the coil spool 1 and to prevent a re-alteration of the previously adjusted yoke and pole piece, the yoke 8 and the pole piece 10 are each provided with assembly shoulders 8*a* and 10*a*.

During assembly one contact mount such as, for example, the mount 3, is first inserted into the coil spool 1. The other contact mount such as, for example, mount 4, is subsequently inserted into the spool 1 from the opposite side to such an extent until the lower counter contact 6 somewhat overlaps the central contact 7. The armature 9 then pulls up, so that the armature 9 pulls up the contact springs 5 by means of the slide 12 and allows the further insertion of the contact mount 4. This manner of assembly is permitted because of the differing lengths of the counter-contact springs 5 and 6.

The coil spool 1 carries in a known manner a winding 13 which can be applied before the contact mount assembly process. The inserted contact mounts 3 and 4, together with the bent yoke 8 and the pole piece 10, can be sealed such as, for example, by a foil 15 at the end face of the relay. A metal cap 16 which serves for flux guidance in a known manner is then placed over the entire relay. The metal cap may be filled with a sealing compound in order to hermetically seal the contact chamber therein.

A further embodiment for guiding and retaining the contact mounts in place is shown in FIGS. 5 and 6. A longitudinal cross section through the coil spool 1 is shown in FIG. 5 in such a manner that the contact carriers 23 and 24 can be seen from the side in an uncut view. A partial view of the contact carrier 24 at the end face of the relay is shown in FIG. 6.

The contact carriers, together with guide ribs 23*a* and 23*b* and 24*a* and 24*b* are held in guide grooves 1*a* and 1*b* of the coil spool 1 as in the preceding embodiment. The preceding embodiment is modified in FIGS. 5 and 6 by the presence of two ribbed projections 23*e* and 23*f* carried on the contact 23, and the presence of ribbed projections 24*e* and 24*f* carried on the contact mount 24. The projections are on the surfaces of both sides of the respective mounts 23 and 24. The fixing planes 23*g* and 24*g* of these ribbed projections are disposed on the same level as the contact surface 23*i* and 24*i* for the yoke 8 and the pole piece 10.

The ribbed projections 23*e*, 23*f* and 24*e*, 24*f* of the contact mounts 23 and 24, and both the yoke 8 and the pole piece 10 are held in guide grooves 1*c* and 1*b* of the coil spool 1 by press fit. The yoke 8 has a lug 8*b* and the pole piece 10 has a lug 10*b* which together with the end wall of the coil spool interior 2 effect a particular penetration so that the yoke 8, the pole piece 10 and the ribbed projections 23*e*, 23*f*, 24*e* and 24*f* are pressed onto the plane 1*e* of the guide grooves 1*c* and 1*d* of the spool 1 at an upper portion of the wall of the interior 2.

The projections extend through recesses 8*c* and 10*c* in the yoke 8 and pole piece 10.

Because the pole piece 10 extends only to the center of the contact carrier 24, the upper side of the ribbed projection 24*f* is provided with an additional penetration rib 24*h*. Additionally, in order to facilitate the assembly a beveled portion 24*k* is molded onto the contact mount 24. This beveled portion 24*k* facilitates insertion if the face end 2*a* of the interior 2 of the coil spool 1 cannot be rounded off for other reasons.

Although modifications and changes may be suggested by those skilled in the art it is the intention of the inventor to embody within the patent warranted hereon all changes and modifications as reasonably and properly come within the scope of his contribution to the art.

I claim as my invention:

1. An electromagnetic relay comprising:

a coil spool about which a coil is wound and having a hollow interior having a plurality of axial guide grooves therein;

a plurality of contact elements disposed approximately axially parallel within said interior of said coil spool;

a yoke and an armature disposed in said interior of said coil spool operable for actuating said contact elements;

a pair of contact mounts which are respectively inserted into opposite ends of said coil spool at opposite open end faces thereof, said contact mounts each carrying and rigidly holding a portion of said plurality of contact elements and one of said pair of contact mounts additionally carrying said yoke and said armature and the other of said contact mounts additionally carrying a pole piece, each of said contact mounts consisting of insulating material and having a U-shape with lateral arms which enclose said contact elements in said interior of said spool and a guide means carried on said lateral arms for engaging said guide grooves up to a center of said coil spool for accurately and fixedly positioning said carrier mounts and said contact elements.

2. The relay of claim 1 wherein said guide means is a plurality of axial guide ribs disposed on said lateral arms and laterally engaging said guide grooves, said guide ribs being molded onto said lateral arms of said contact mounts.

3. The relay of claim 1 wherein said portion of said plurality of contact elements carried by each contact mount are embedded in a respective contact mount.

4. The relay of claim 1 wherein said yoke and said pole piece engage a guide groove in said coil spool on opposite sides thereof.

5. The relay of claim 4 wherein said yoke and said pole piece each have assembly shoulders at the end faces thereof.

6. The relay of claim 5 wherein said plurality of contact elements consist of stationary central contacts and counter-contact springs, and wherein one of said pair of contact mounts carries said stationary central contacts parallel to one another and the other of said contact mounts carries said counter-contact springs and wherein said counter-contact springs are pre-loaded against one another and against an associated central contact.

7. The relay of claim 6 wherein counter-contact springs associated with a central contact have unequal lengths.

8. The relay of claim 1 further comprising a plurality of guide projections molded on said contact mounts, said guide projections being pressed against a lower edge of said guide grooves by said yoke or said pole piece, said yoke and said pole piece being carried by respective ones of said contact mounts and being supported against an upper wall of said hollow interior of said spool.

9. The relay of claim 8 wherein said yoke and said pole piece are supported by integral lugs carried on said interior of said spool.

10. The relay of claim 8 wherein said yoke and said pole piece each have a plurality of lateral recesses which engage said guide projections.

11. The relay of claim 8 further comprising a penetration projection which is supported on an upper portion of said interior of said spool and is molded onto at least one of said guide projections.

* * * * *